United States Patent [19]

Miller

[11] Patent Number: 4,718,129

[45] Date of Patent: Jan. 12, 1988

[54] SWIMMING POOL VACUUM APPARATUS

[76] Inventor: Robert E. Miller, 19050 Colima Rd., Rowland Heights, Calif. 91748

[21] Appl. No.: 44,666

[22] Filed: May 1, 1987

[51] Int. Cl.[4] ..... E04H 3/20

[52] U.S. Cl. ..... 4/490; 4/661; 15/1.7; 210/169

[58] Field of Search ..... 4/490, 492, 661, 507; 210/169 R; 15/1.7; 134/167 R

[56] References Cited

U.S. PATENT DOCUMENTS

| | | | |
|---|---|---|---|
| 471,840 | 3/1892 | Blessing | 210/94 X |
| 2,979,733 | 4/1961 | Clair et al. | 4/490 X |
| 3,000,508 | 9/1961 | Spaulding et al. | 210/169 R X |
| 3,169,920 | 2/1965 | Payne | 210/169 R |
| 3,443,264 | 5/1969 | Miller | 4/490 |
| 3,579,657 | 5/1971 | Gurrieri | 4/490 |
| 4,443,899 | 4/1984 | Johnson | 15/1.7 |

*Primary Examiner*—Henry K. Artis

*Attorney, Agent, or Firm*—Edward D. O'Brian

[57] ABSTRACT

A swimming pool vacuum apparatus as described in the U.S. Pat. No. 3,443,264 can be improved by providing a plate holding an outlet nipple from the container of such an apparatus on the bottom of the container so that the position of the outlet nipple can be varied or changed by changing the position of the plate. The lid in such an apparatus is improved through the use of a peripheral groove on the lid facing the top of the container containing an O-ring which fits against the container so as to form a seal with it. Preferably spacers are provided limiting the amount that the O-ring can be compressed and holding the O-ring within the groove.

7 Claims, 6 Drawing Figures

SWIMMING POOL VACUUM APPARATUS

BACKGROUND OF THE INVENTION

The invention set forth in this specification pertains to a new and improved swimming pool vacuum apparatus.

More specifically this invention pertains to an improvement of an apparatus of the type disclosed and claimed in the U.S. Pat. No. 3,443,264 entitled "Swimming Pool Vacuuming Apparatus" which issued on May 13, 1969. This prior patent covered a structure which, when used, enabled the usual skimmer type strainer well employed with a pool to be utilized in connecting a vacuum line or tube to the pump normally used with a swimming pool for filtering and recirculating pool water. As a result of utilizing a vacuuming apparatus as disclosed in this prior patent it is considered possible to simplify the use of a vacuum tube or line in cleaning a pool.

Swimming pool vacuum apparatus as shown in this prior patent is considered to be both effective and desirable. However, it has been noted that with this prior type of apparatus there is at least a potential danger of the canister or container employed in the structure between a skimmer well outlet and a vacuum tube leaking as a result of the lid for the container being shifted slightly out of place during the installation and/or manipulation of the vacuum line. Obviously, if the lid to such a canister or container should become mislocated for any reason there is a danger of some ambient air or liquid being drawn into the container while the pool vacuum is being operated or while it is attempted to operate the pool vacuum.

Also, it has been realized that frequently a container or canister as indicated in the prior patent noted in the preceding is not satisfactory for use in a swimming pool strainer well because of the fact that the outlet from such a well is located relatively adjacent to the wall of such a well. Whenever this has occurred it has been necessary to insert what may be best described as "jury rigged" piping or tubing connection between the outlet from the bottom of the strainer well and the bottom outlet of the canister or container of the vacuum apparatus in order to be able to utilize such apparatus. The use of such a makeshift type of connection is considered to be undesirable because of the inherent character or nature of any sort of a makeshift apparatus used as a conduit for fluid.

BRIEF SUMMARY OF THE INVENTION

As a result of the preceding considerations it is believed that it will be apparent that there is a need for new and improved swimming pool vacuum apparatus. This invention is intended to supply new and improved apparatus meeting this need. The invention is intended to provide swimming pool vacuum apparatus which is more desirable than prior related apparatus as shown in the noted U.S. Pat. No. 3,443,264 by: (1) providing a new method of securing the lid and the container in such an apparatus to avoid any reasonable possibility of the lid being misplaced to even a degree during the installation and use of such a vacuum apparatus; or (2) providing a new outlet for the container so as to enable the container to be used in swimming pool strainer wells having outlets located adjacent to an interior walls of such wells; or (3) by providing both of the preceding items (1) and (2).

In accordance with this invention these various objectives are achieved by providing in a swimming pool vacuum apparatus including a container including a bottom having an outlet nipple extending therefrom and a normally open top, and a lid forming a part of the container and closing off the top of said container, the lid having a tubing nipple extending from the top thereof in which the improvement comprises: said lid having a peripheral groove formed therein and located so as to be opposite the top of said container, an elastomeric O-ring located within said groove and fitting against said top of said container, spacer means located on said lid around the periphery of said groove for limiting the amount said O-ring can be compressed and for preventing movement of said O-ring out of said groove, and coacting holding means on said lid and on said exterior of said container adjacent to the top thereof for use in attaching said lid to said container so that said O-ring is in engagement with said end of said container.

BRIEF DESCRIPTION OF THE DRAWINGS

Because of the nature of this invention it is best more fully explained with reference to the accompanying drawings in which.

Figure 1:
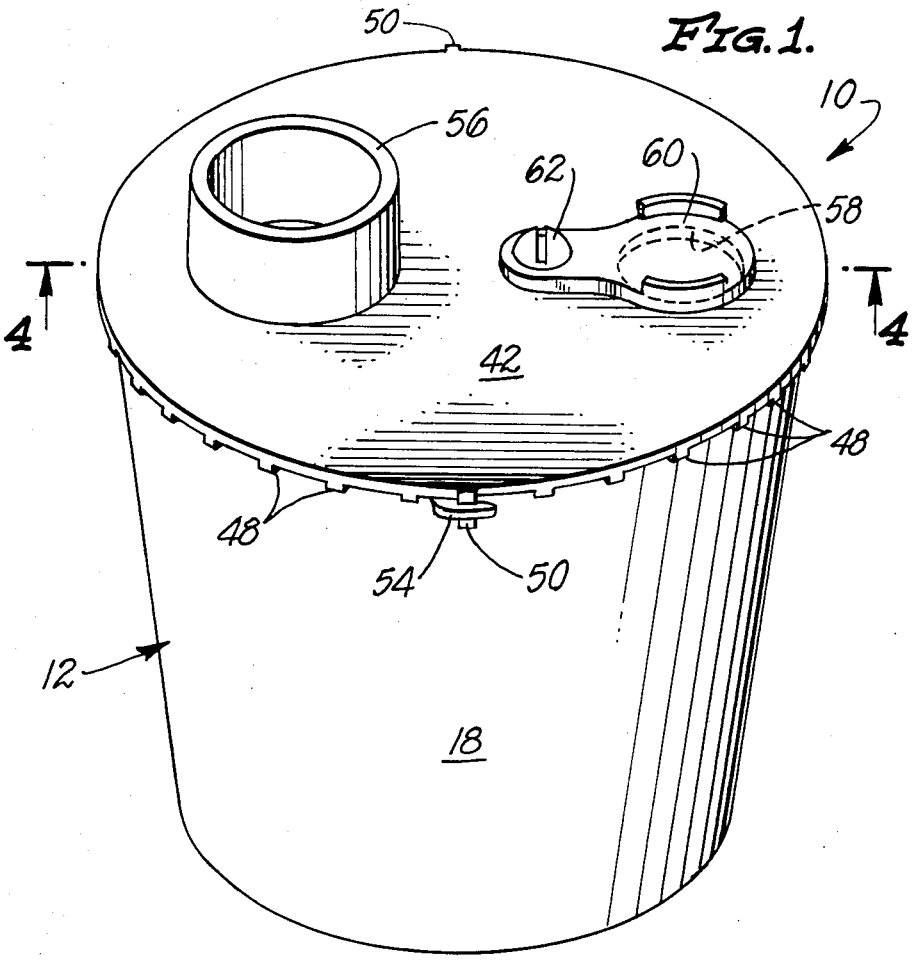
FIG. 1 is a isometric view of a presently preferred embodiment or from of a swimming pool vacuum apparatus in accordance with this invention.
Figure 2:
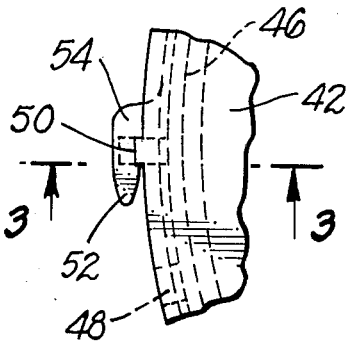
FIG. 2 is a partial top plan view at an enlarged scale of the apparatus shown in FIG. 1.
Figure 3:
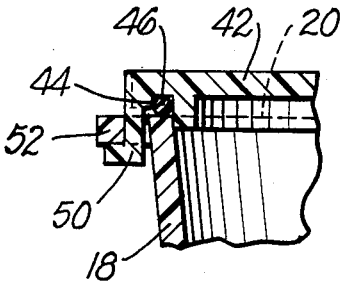
FIG. 3 is a partial cross sectional view taken about the line 3—3 of FIG. 2.

The precise swimming pool vacuum apparatus illustrated in the drawing and described in the remainder of this specification is constructed so as to utilize the operative concepts of this invention set forth and defined in the appended claims forming a part of this specification. Those skilled in the field of the design and construction of vacuum operated swimming pool cleaning structures will realize that the operative concepts and principles of this invention can be embodied within a wide variety appearing and somewhat differently constructed types of equipment or apparatuses through the use or exercise of routine skill in the noted field. For this reason the invention is not to be considered as being limited by the accompanying drawings but is to be considered as being limited solely by the appended claims.

DETAILED DESCRIPTION OF THE PREFERRED EMBODIMENT

In the drawing there is shown a swimming pool vacuum apparatus 10 which is utilized in substantially the same manner as the vacuum apparatus described in the prior U.S. Pat. No. 3,443,262 indicated in the preceding discussion. Because of the relationship between this prior patent and the present invention the entire disclosure of this prior patent is incorporated herein by reference. This apparatus 10 utilizes a more or less pail shaped container 12 having a bottom 14 and a normally open top 16. Preferably the container 12 is constructed so as to have a continuous side 18 shaped as a frustrum of a right circular cone because this simplifies the molding of the container 12 out of polymer material and because this shape is more resistant to breakage than a generally rectilinear container. The side 18 terminates in a flat top edge 20 surrounding the top 16.

In the bottom 14 of the container 12 there is located a generally rectilinear opening 22 having a small, centrally located, internal stud 24 located along one of its shorter edges 26. This opening 22 is adapted to be closed through the use of a closure plate 28 shaped so as to overlay the opening 22. When it is in use in such an overlaying position the plate 28 has a small hook like lip 30 which fits over an edge 32 opposite the edge 26 in such a manner that the plate 28 is located so that an opening 34 in it is directly opposite the hollow stud 24. This enables the plate 28 to be secured in place through the use of a single fastener 36.

Figure 6:
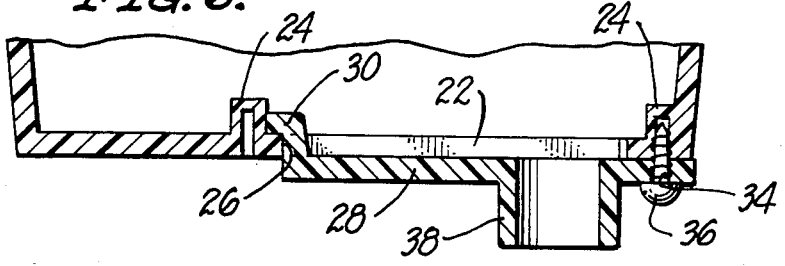
FIG. 6 is a partial cross sectional view taken about the line 6—6 of FIG. 5.

If for any reason the bottom opening of such a strainer well should not be centrally located within the well it is possible to disassemble the plate 28 by removing the fastener 36 and to locate the lip 30 so that it engages the edge 26 instead of the edge 32 as shown in FIG. 6. At this point the plate 28 may be resecured by inserting the fastener 36 through the opening 32 into a further hollow stud 24 corresponding to the stud 24 previously described. This will, of course, locate a nipple 38 on the pole 28 generally adjacent to the side 18 in a position such that it can normally be inserted into the outlet opening (not shown) of a swimming pool strainer well (not shown) which is located closely adjacent to the wall of such a well. Preferably the fastener 36 used is a self threading screw since when such a screw is used there is no need for threading the interior of the stud 24. When it is so located normally a sealing ring (not shown) as described in the prior U.S. Pat. No. 3,443,264 will be located around the nipple 38 so as to form a seal between the bottom 14 of the container 12 as the bottom of such a strainer well.

The container 12 is utilized with a lid 42 which is adapted to overly both the top 16 and the side 18. This lid 42 includes a downwardly facing peripheral groove 44 which is directly opposite the top edge 20. Normally a comparatively small elastomeric O-ring 46 will be located within the groove 44 in such a location that it will rest against the top edge 20. It is preferred to utilize a series of equally spaced holders or spacers 48 on the lid 16 in such locations that they will tend to prevent the O-ring 46 from being dislodged from the groove 44. These holders or spacers 48 are preferably of less height than the O-ring 46 and, hence, serve to limit the amount to which the O-ring 46 can be compressed during the use of the apparatus 10.

The lid is, in addition, secured in place by means of downwardly extending headed lugs 50 on the lid 42 snapping past heads 52 on bayonet lugs 54 which are located on the container 12 immediately adjacent to the top edge 20 as the lid 42 is twisted. If desired the two sets of lugs 50 and 54 may be referred to as cooperating holding lug bayonet joint means. In order to complete the lid 42 it includes an upstanding nipple 56 and a vacuum breaker opening 58 which is adapted to be closed by means of a small plate 60. This plate 60 is pivotally mounted upon another fastener 62 extending into another hollow boss 64.

It is believed that the installation and use of the apparatus 10 will be self evident from a consideration of the prior U.S. Pat. No. 3,443,264 and from the preceding description. When the apparatus is to be utilized the plate 28 will be positioned either in the position shown in FIG. 4 of the drawing or in the position shown in FIG. 5 of the drawing depending upon the nature of the outlet opening (not shown) of a swimming pool strainer well (not shown). It is considered advantageous that this plate 28 can be positioned so that the nipple 38 can extend directly into an outlet opening (not shown) in virtually any location in the bottom of the swimming pool strainer well. As the apparatus 10 is located in such a way a known sealing ring (not shown) will, of course, be located around the nipple 38 so as to form a seal with the strainer well. Normally the sealing ring used will accommodate a limited or restricted amount of movement of the apparatus 10 without leakage occurring as the complete apparatus 10 is used.

Next during the use of the apparatus 10 the lid 42 will be located as shown on the drawing and placed on the container 12. Because of the manner in which the lid 42 is formed the O-ring 46 will normally rest against the top edge 20 so that a seal will be formed with the top edge 20 due to the weight of the lid 42. Because of the inherent nature of the O-ring 46 a minor degree of misalignment of the lid 42 with the top 16 can be tolerated. Then it is possible to connect a conventional vacuum line (not shown) such as is used with a pool cleaning implement (not shown) to the nipple 56. If it has not already been done the plate 60 will then be located directly over the opening 58. As such a line is being connected to the nipple 38 minor degrees of movement of the lid 42 will not interfere with the "fit" of the lid 42 relative to the container 12. Indeed, because of the use of the spacer elements 48 it will be under most circumstances be impossible to locate the lid 42 so that a seal will not be formed against the top edge 20 even if lugs 50 and 54 are omitted.

As the apparatus is used after being so connected the vacuum "pulled" through the bottom nipple 38 will normally be adequate to draw the lid 42 down against the top edge 20 so as to firmly secure the lid 42 in such a manner so that the O-ring 46 cannot be dislodged and in such a manner that the lid 42 will be held in position. It is considered that the spacer elements 48 will prevent the O-ring 46 from being displaced from the groove 42 so as to seal by limiting the amount that the O-ring 46 can be compressed and by limiting the amount that the O-ring 46 can be expanded outwardly. As a consequence of these factors the apparatus 10 is considered to be more desirable than the prior related apparatus since there is little of any danger of manipulation of a hose relative to the nipple 56 interfering with the desired seal being achieved between the lid 42 and the container 12.

I claim:

1. A swimming pool vacuum apparatus including a container including a bottom having an outlet extending therefrom and a normally opened top, and a lid forming a part of the container closing off the top of said container, the lid having a tubing nipple extending from the top thereof in which the improvement comprises:

said lid having a peripheral groove formed therein and located so as to be opposite the top of said container, an elastomeric O-ring located within said groove and fitting against said top of said container, spacer means located on said lid around the periphery of said groove for limiting the amount said O-ring can be compressed and for preventing movement of said O-ring out of said groove, and coacting holding joint means on said lid and on said exterior of said container adjacent to the top thereof for use in attaching said lid to said container so that said O-ring is in engagement with said end of said container.

2. The swimming pool vacuum apparatus as claimed in claim 1 wherein:

said coacting holding means are bayonet joint means capable of being engaged with one another by locating said lid on said container and twisting said lid.

3. The swimming pool vacuum apparatus as claimed in claim 1 wherein:

said spacer means comprise a series of equally spaced spacers located around the periphery of said lid, said spacers being of less height than said O-ring.

4. The swimming pool vacuum apparatus as claimed in claim 1 wherein:

said coacting holding means are bayonet joint means capable of being engaged with one another by locating said lid on said container and twisting said lid, said spacer means comprise a series of equally spaced spacers located around the periphery of said lid, said spacers being of less height than said O-ring.

5. The swimming pool vacuum apparatus as claimed in claim 1 wherein:

said bottom of said container includes a bottom opening and a plate secured to said bottom so as to close off said opening, said outlet nipple being located on said plate adjacent to one extremity thereof, said plate being movable relative to said bottom opening so that said outlet nipple can be located in different positions relative to said bottom of said container.

6. The swimming pool vacuum apparatus as claimed in claim 5 wherein:

said opening has opposed parallel edges, said plate includes a lip which fits over one of said edges, said bottom includes bosses adjacent to both of said edges, said bottom also including a fastener capable of securing said plate to either of said bosses.

7. The swimming pool vacuum apparatus as claimed in claim 1 wherein:

said coacting holding means are bayonet joint means capable of being engaged with one another by locating said lid on said container and twisting said lid, said spacer means comprise a series of equally spaced spacers located around the periphery of said lid, said spacers being of less height than said O-ring, said bottom of said container includes a bottom opening and a plate secured to said bottom so as to close off said opening, said outlet nipple being located on said plate adjacent to one extremity thereof, said plate being movable relative to said bottom opening so that said outlet nipple can be located in different positions relative to said bottom of said container, said opening has opposed parallel edges, said plate includes a lip which fits over one of said edges, said bottom includes bosses adjacent to both of said edges, said bottom also including a fastener capable of securing said plate to either of said bosses.

* * * * *

UNITED STATES PATENT AND TRADEMARK OFFICE

CERTIFICATE OF CORRECTION

PATENT NO. : 4,718,129

DATED : January 12, 1988

INVENTOR(S) : Robert E. Miller

Figure 4:
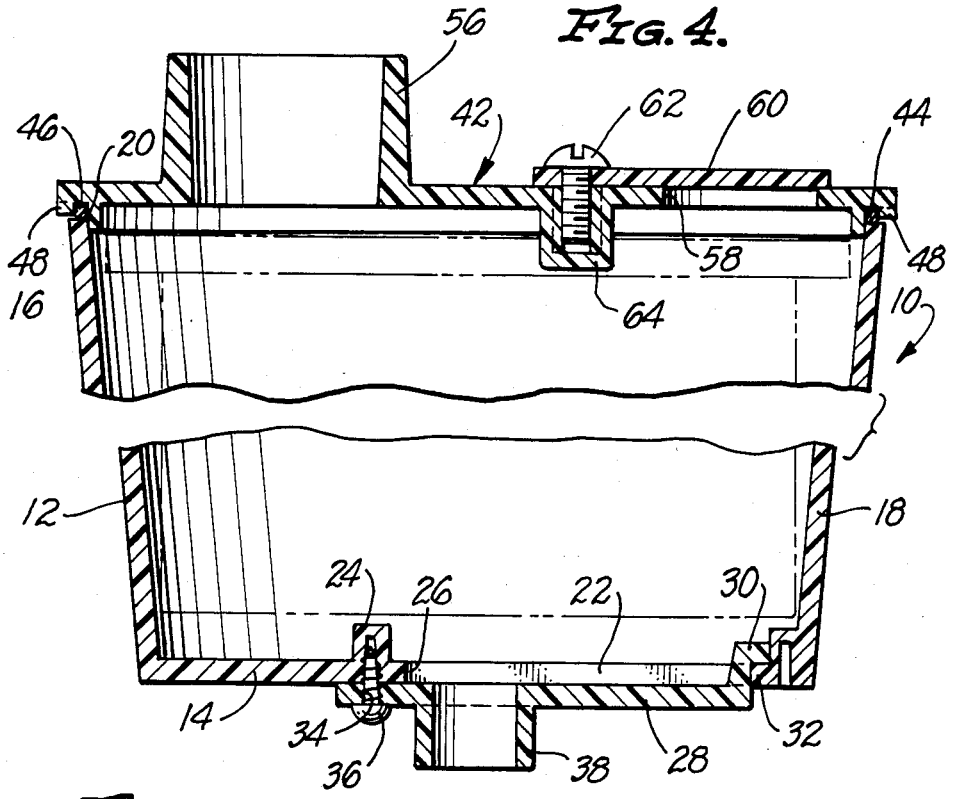
FIG. 4 is a cross sectional view taken about the line 4—4 of FIG. 1.
Figure 5:
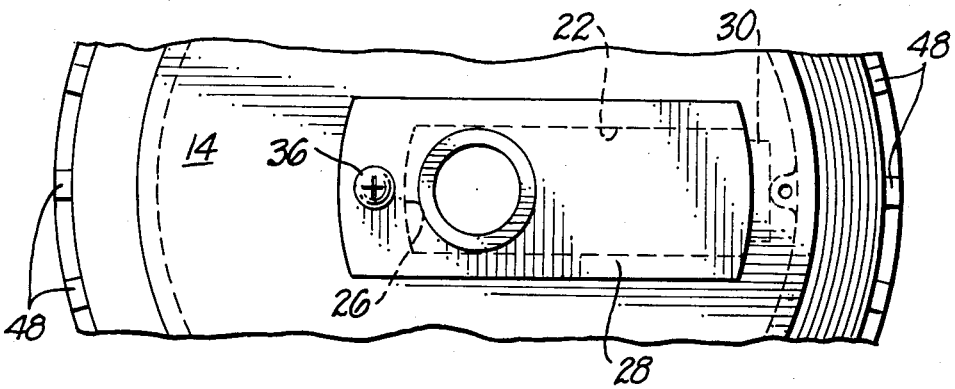
FIG. 5 is a partial bottom plan view of the vacuum apparatus as illustrated in the preceding FIGS. 1 and 4.

It is certified that error appears in the above-identified patent and that said Letters Patent is hereby corrected as shown below:

Column 2, line 41, delete "taken about the line 6-6 of Fig. 5." and insert in lieu of --similar to Fig. 4 showing a modified arrangement of parts.--.

Column 2, line 63, "3,443,262" should read --3,443,264--.

Column 3, line 26, "opening 32" should read --opening 34--.

Column 3, line 29, " pole" should read --plate--.

Column 3, line 55, "lid" should read --lid 42--.

Column 4, line 5, "Fig. 5" should read --Fig. 6--.

Signed and Sealed this

Fifteenth Day of November, 1988

*Attest:*

*Attesting Officer*

DONALD J. QUIGG

*Commissioner of Patents and Trademarks*